US005673913A

United States Patent [19]

Toler et al.

[11] Patent Number: 5,673,913

[45] Date of Patent: Oct. 7, 1997

[54] PINBALL GAME WITH ELECTROMAGNET

[75] Inventors: Michael D. Toler; Ward L. Pemberton, both of Chicago, Ill.

[73] Assignee: Sega Pinball, Inc., Melrose Park, Ill.

[21] Appl. No.: 659,351

[22] Filed: Jun. 6, 1996

[51] Int. Cl.[6] ..... A63F 7/30

[52] U.S. Cl. ..... 273/118 D; 273/118 A; 273/119 A; 273/121 A

[58] Field of Search ..... 273/118–121, 127 R, 273/129 R

[56] References Cited

U.S. PATENT DOCUMENTS 1,648,956 11/1927 Meade .
4,373,725 2/1983 Ritchie .
4,542,905 9/1985 Hooker .
5,158,291 10/1992 Biagi et al. .
5,356,142 10/1994 Borg et al. .
5,358,242 10/1994 Trudeau et al. .
5,375,829 12/1994 Lawlor et al. .
5,415,403 5/1995 Ritchie et al. ..... 273/121 A
5,494,286 2/1996 DeMar et al. .
5,518,236 5/1996 Morrison ..... 273/118 A

*Primary Examiner*—Raleigh W. Chiu
*Attorney, Agent, or Firm*—Gerstman, Ellis & McMillin, Ltd.

[57] ABSTRACT

A pinball game in which an electromagnet is positioned on or below the playfield. A computer-controlled circuit is connected to the electromagnet and is operable to detect and control the pinball in response to changes in the magnetic field of the electromagnet.

24 Claims, 6 Drawing Sheets

PINBALL GAME WITH ELECTROMAGNET

FIELD OF THE INVENTION

The present invention concerns a novel pinball game, and, in particular, a pinball game in which one or more electromagnets are used above or below the playfield of the pinball game.

BACKGROUND OF THE INVENTION

Because the pinballs used in pinball games are generally formed of a ferromagnetic material such as steel, it is known in the art to utilize an electromagnet for attracting and/or propelling the pinball. In DeMar et al. U.S. Pat. No. 5,494,286, a pinball game is disclosed in which an electromagnet operates in response to optical sensors that detect when a pinball is present. Once the optical sensors detect the presence of the ball, the electromagnet is energized.

The optical ball detecting system disclosed in the DeMar et al. patent is disadvantageous in that it cannot determine the proximity of the pinball to the electromagnet, nor can it detect the speed of the pinball in its movement relative to the electromagnet. For that reason, in the operation of the DeMar et al. device the electromagnet may be energized prematurely, once the optical pinball detector has detected the presence of a pinball. The windings of electromagnets can only be energized for a predetermined period of time before overheating. A thermal sensor, such as a bimetallic strip, is ordinarily attached to the electromagnet to sense the heat of the coil. Once overheated, the electromagnet must be deenergized and it may be several minutes until the electromagnet can be reenergized.

The heating problem occurs when the electromagnet coil is energized to attract and grab the ball. When the pinball rolls over the magnet, under some conditions the pinball might move back and forth until it is held in the center of the core. During that movement of the pinball, when it is being attracted to the center of the core, the coil is heated significantly and a serious heating problem may occur. The operation is like a poorly damped oscillation in which the heat is not being dissipated. Because of the mechanical oscillation that can occur once the ball is adjacent the core of the electromagnet, it is desirable to be able to inductively observe the movement of the ball with respect to the magnetic core. Such observation cannot be made by the optical sensors of the DeMar et al. patent.

Another patent which relates to a pinball game with an electromagnet is Hooker U.S. Pat. No. 4,542,905. The Hooker patent concerns a ball detector utilizing an electromagnet which detects the presence of a pinball that is moving faster than a predetermined minimum speed. The Hooker patent discloses measuring the time rate of change of the magnetic flux induced by passage of a moving pinball. However, if the pinball is not moving, it cannot be detected. Further, Hooker's electromagnetic pinball detector does not operate to attract and/or control the pinball.

It is advantageous to be able to detect the positioning and movement of the pinball in significant detail in order to determine how and when an electromagnet should be energized. It is, therefore, an object of the present invention to provide a pinball machine having a computer-controlled circuit and an electromagnet for detecting and controlling a pinball.

Another object of the present invention is to provide a pinball game in which the proximity of the pinball with respect to an electromagnet carried by the play field is determined in response to changes in the magnetic field of the electromagnet.

A still further object of the present invention is to provide a pinball game in which the driving electromagnet carried by the playfield operates as the sensing device in addition to operating as the attraction and holding device.

A still further object of the present invention is to provide a pinball game that obviates the need for using optical sensors associated with the electromagnet for detecting the presence of the pinball.

Another object of the present invention is to provide a pinball game that is simple in construction and relatively easy to manufacture.

Other objects and advantages of the present invention will become apparent as the description proceeds.

SUMMARY OF THE INVENTION

In accordance with the present invention, a pinball game is provided which comprises a playfield, at least one pinball for rolling on the playfield, and a supporting structure for the playfield. An electromagnet is positioned on or below the playfield. A computer-controlled circuit is connected to the electromagnet, with the computer-controlled circuit and electromagnet being operable to detect and control the pinball in response to changes in the magnetic field of the electromagnet.

In the illustrative embodiment, the electromagnet simultaneously detects the pinball and controls its position. The computer-controlled circuit is responsive to a change of inductance of the electromagnet over time to determine the movement of the pinball.

In the illustrative embodiment, the magnetic field is operative to (a) attract the pinball and (b) aide in detecting the proximity of the pinball. The computer-controlled circuit is operative to provide pulses to the electromagnet and to receive return pulses indicative of the proximity of the pinball with respect to the electromagnet. The computer-controlled circuit includes a computer for generating pulses, a driver for amplifying the pulses generated by the computer, and a pulse-forming network for shaping the pulses from the driver and for feeding the shaped pulses to the electromagnet. The return pulses are fed to a zero-crossing detector whereby the proximity of the pinball is indicated in response to the output of the zero-crossing detector.

In the illustrative embodiment, the computer-controlled circuit is operable to provide different pulses to the electromagnet for (a) detecting the proximity of the pinball, (b) attracting the pinball, and (c) holding the pinball.

In the illustrative embodiment, the playfield is inclined and comprises an outhole for the pinball. The electromagnet is positioned close to but upstream of the outhole whereby the pinball can be attracted to the electromagnet under predetermined conditions and thereby prevented from rolling into the outhole. The playfield has a pair of flippers upstream of the outhole and near the outhole and the electromagnet is positioned between the flippers and the outhole.

In a method for operating a pinball game in accordance with the present invention, a play field and a supporting structure for the playfield are provided. An electromagnet is positioned on or below the play field. The pinball is detected and controlled in response to changes in the magnetic field of the electromagnet.

A more detailed explanation of the invention is provided in the following description and claims and is illustrated in the accompanying drawings.

DETAILED DESCRIPTION OF THE ILLUSTRATIVE EMBODIMENT

Figure 1:
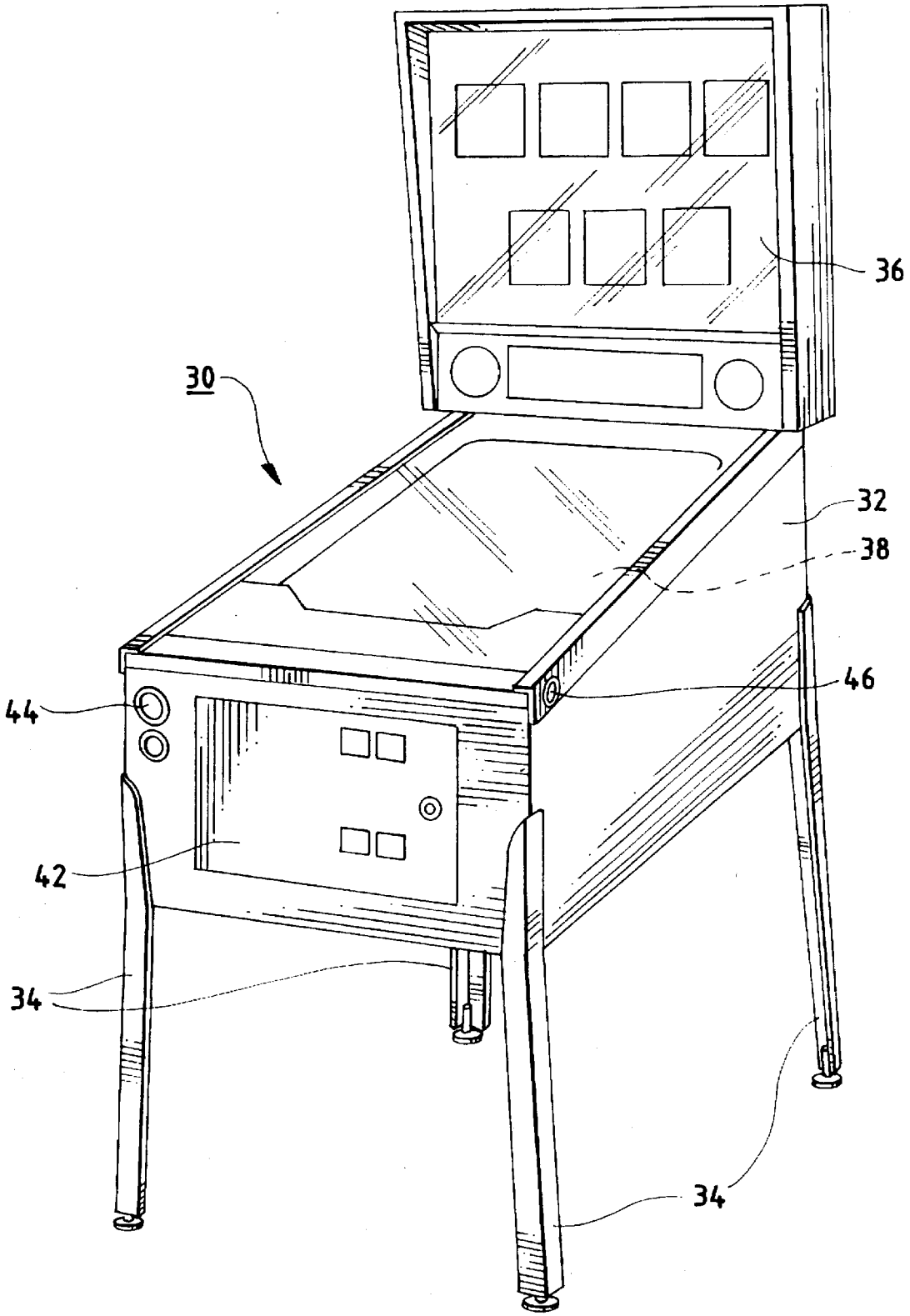
FIG. 1 is a perspective view of a pinball game constructed in accordance with the principles of the present invention.
Figure 2:
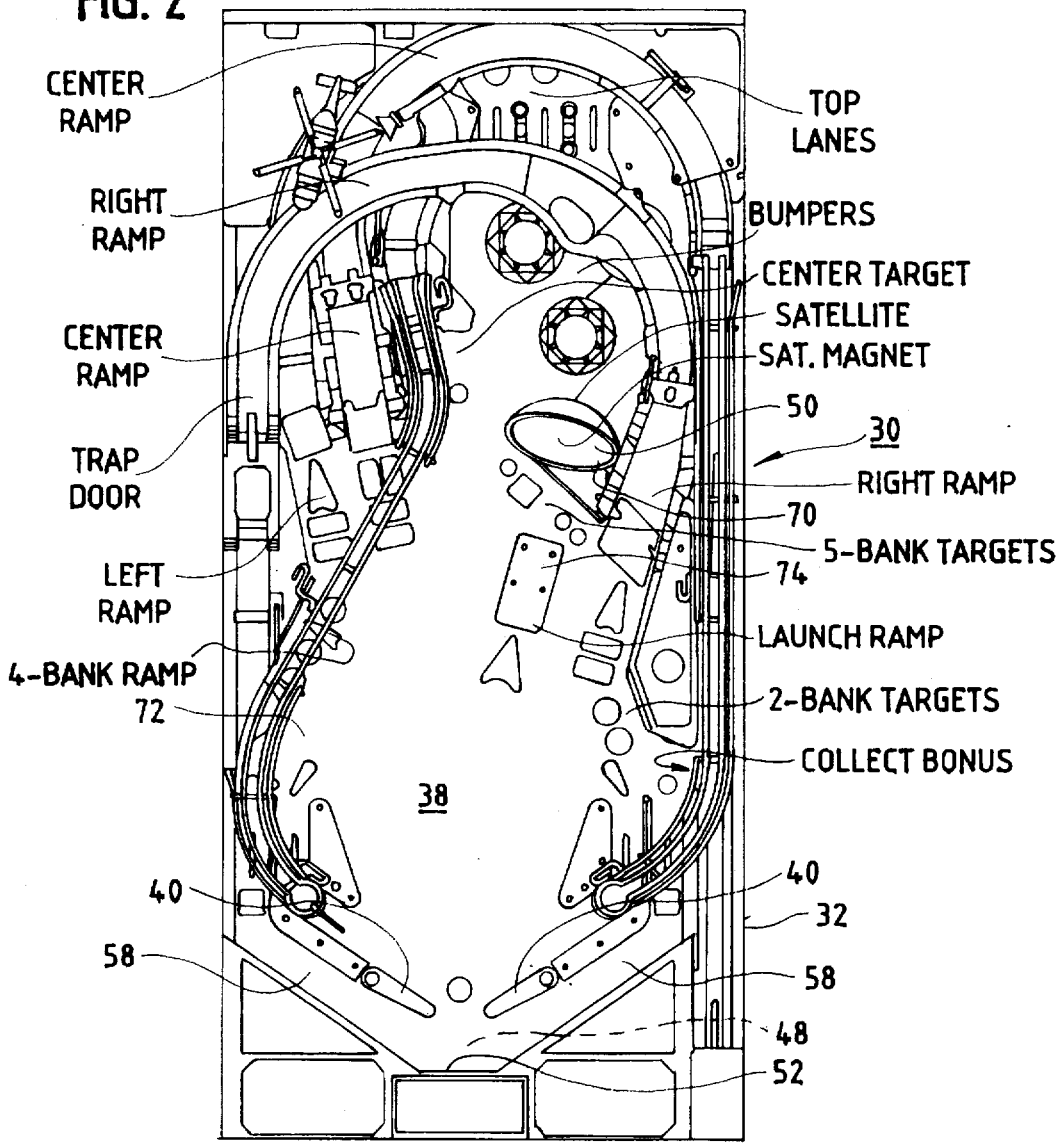
FIG. 2 is a top plan view of a playfield in the pinball game of FIG. 1.
Figure 3:
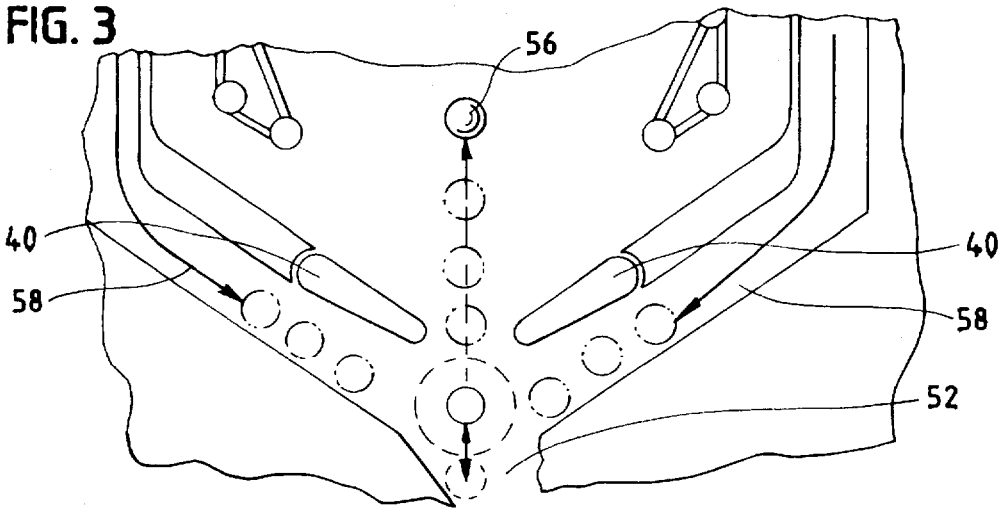
FIG. 3 is a diagrammatic view of the outhole electromagnet on the play field of FIG. 2.

Referring to FIGS. 1–3, a pinball machine 30 is shown therein including a central body 32 attached to a plurality of legs 34, with a scoreboard 36 and an inclined playfield 38. Balls are propelled onto the playfield 38 where a ball can be struck by a plurality of flippers 40 and can then travel around the playfield via ramps and strike targets as is well known in the art. The central body 32 has a coin door 42 for access to the interior, a start button 44, and flipper control buttons 46, as is well known in the art.

In the illustrative embodiment, the pinball machine 30 uses two electromagnets 48 and 50 for enhancing the enjoyment of playing the pinball game. The first magnet 48 is located between the left and right flippers 40, upstream of the outhole 52. In this manner, under certain conditions (for example during the first 10 seconds of the pinball game) if the pinball 56 falls through the flippers 40, instead of traveling into the outhole 52 it can be attracted to and held by the magnet 48 and then shot back into the playfield 38. The first magnet 48 may be located so that it receives a ball falling through the left and right flipper, or so that it receives a ball travelling in the shooter lane 58 (FIG. 3) behind one of the flippers 40, or both. This is illustrated in FIG. 3 in which the magnet 48 is placed to be able to attract the pinball 56 falling through the flippers 40 or returning through the shooter lanes 58. The magnet 48 may be energized to attract the ball during a predetermined time at the beginning of the pinball game or at other times in response to various scores or in response to hitting certain targets.

Figure 5:
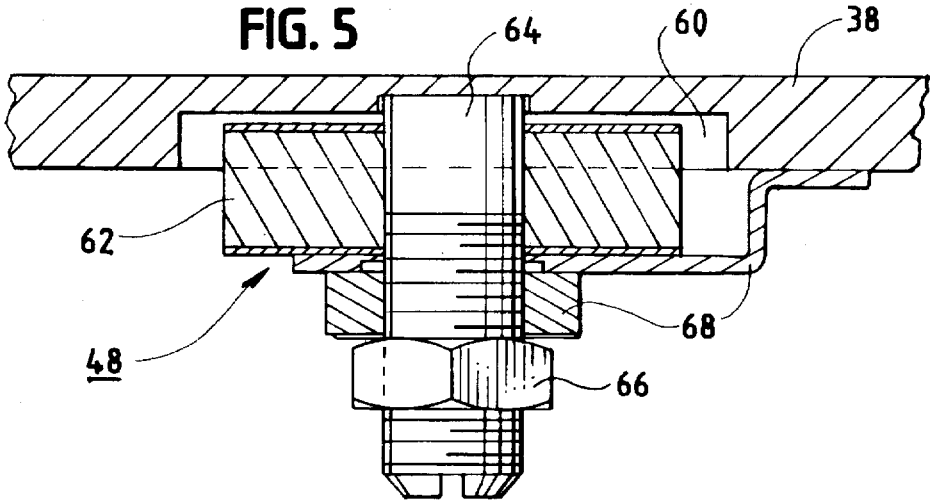
FIG. 5 is a cross-sectional view of the flipper electromagnet in the pinball game of FIG. 2.
Figure 6:
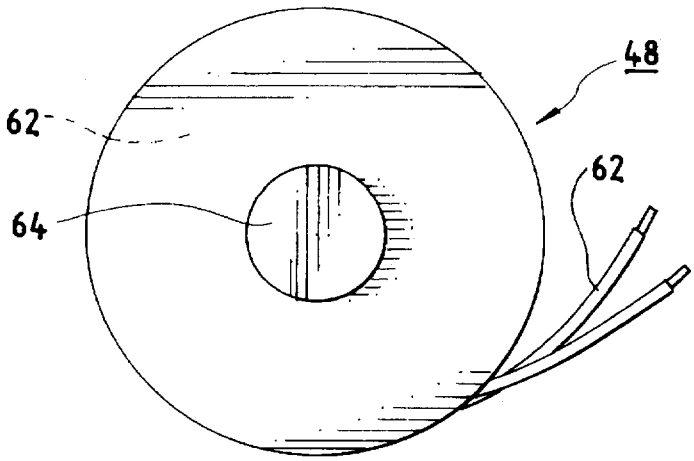
FIG. 6 is a top plan view thereof.

The first magnet 48 is located below the playfield 38 as illustrated in detail in FIGS. 5 and 6. As illustrated in FIG. 5, the playfield 38 defines a circular recess 60 in which the windings 62 of magnet 48 are positioned with a central coaxial steel core 64. Although no limitation is intended, in the illustrative embodiment electromagnet 48 is formed using 22 gauge wire, with 650 turns, on a 2.5 inch form, with a height of approximately 0.75 inch. The internal diameter of the coil 62 is 0.75 inch to receive a core 64 having an outer diameter of slightly less than 0.75 inch and formed of cold rolled steel. Core 64 is externally threaded to receive a nut 66 for holding the electromagnet 48 to a welded bracket assembly 68 under the playfield. A heat sensor (not shown) is connected in series with the coil 62. The heat sensor is an 85° C. bimetallic resettable thermal breaker.

Figure 4:
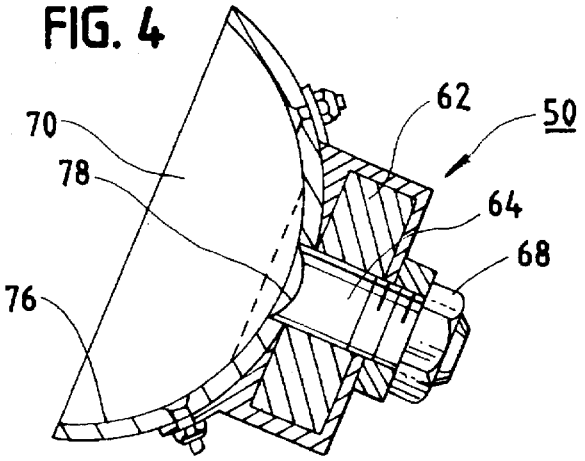
FIG. 4 is a side elevational view, partly in cross-section, of one of the electromagnets positioned on the top of the playfield of FIG. 2.

In the illustrative embodiment, as seen in FIGS. 2 and 4, the second magnet 50 is positioned in a simulated satellite dish 70 on the top surface 72 of the playfield 28. A launch ramp 74 is located proximal of the satellite dish 70 and the satellite dish is pivoted via a motor. During play, if the satellite dish 70 is in the proper position aligned with the ramp 74, the ball goes into the back of the dish and is held by the magnet 50. The ball can be released after a predetermined time or in response to another pinball hitting a predetermined target or obtaining a certain score.

In FIG. 4, the satellite dish 70 with the magnet 50 is illustrated. It can be seen that the magnet is located behind the parabolic reflector portion 76 of the satellite dish 70. In the illustrative embodiment, the second magnet 50 is identical to the first magnet 48 except that the end 78 of the steel core 64 is dished, with approximately the same curvature as a pinball, to receive and hold a pinball.

Figure 7:
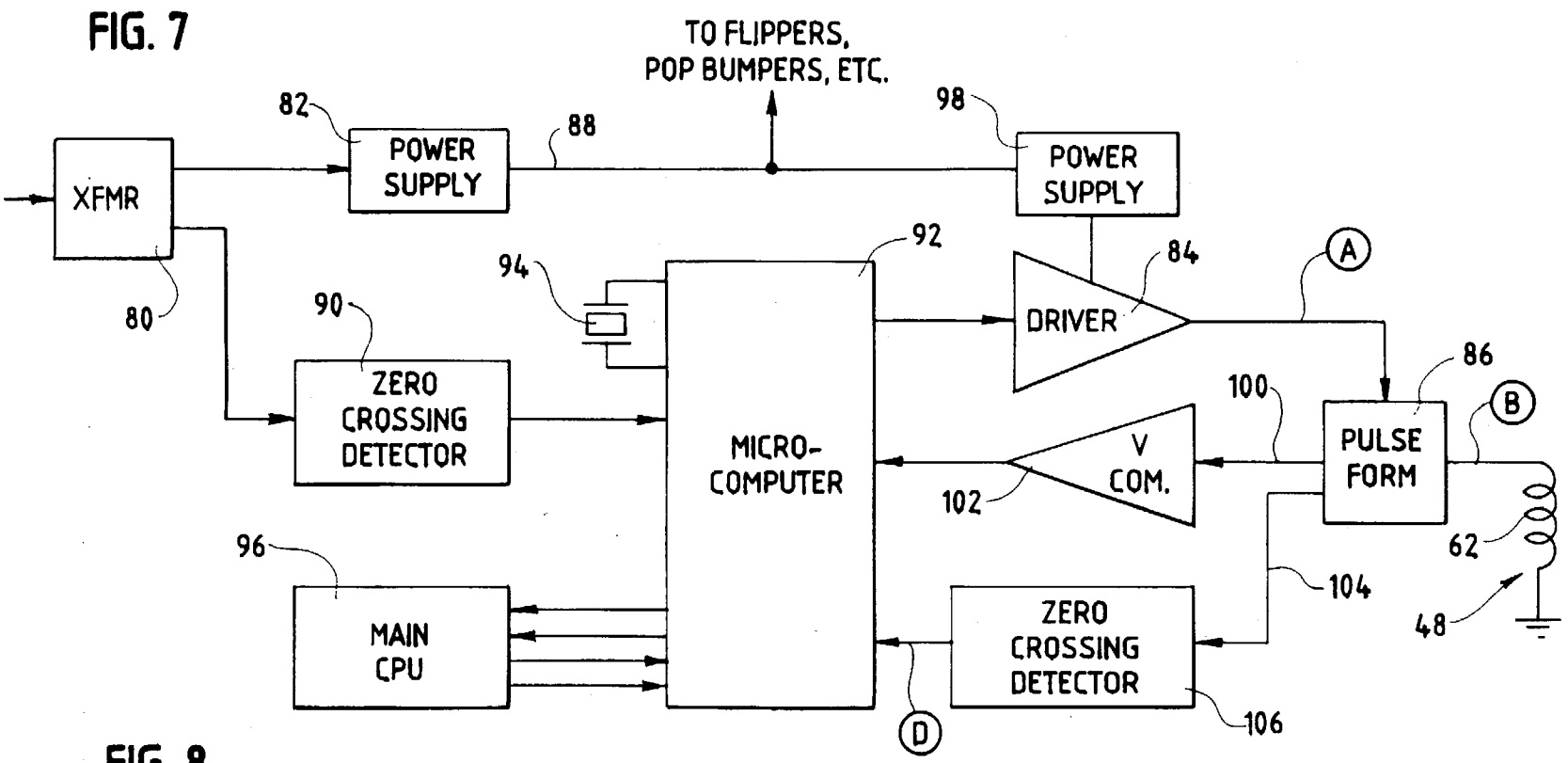
FIG. 7 is a block diagram of a computer-controlled circuit for determining the proximity of a pinball with respect to the electromagnet.
Figure 8:
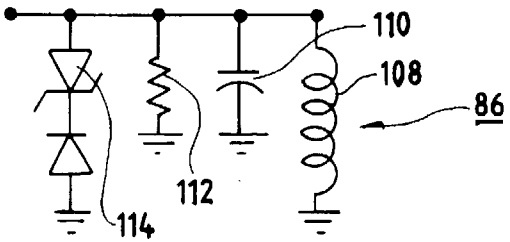
FIG. 8 is a circuit diagram of the pulse-forming circuit of FIG. 7.

The circuit for energizing the electromagnet is illustrated in FIGS. 7 and 8. Referring to FIG. 7, the basic supply voltage, for example 110 VAC, is fed to a transformer 80 preferably having a 50 volt AC output and a 9 volt AC output. The 50 volt AC output is fed to a power supply 82 which comprises a rectifying and filtering circuit for providing a relatively smooth DC output. The DC output from the power supply feeds the flippers, pop bumpers, etc. of the pinball machine and also feeds a driver 84 for a pulse forming network 86 which feeds the electromagnet 48. With no load on the output 88 of the DC power supply, there is a 75 volt DC output. However, with the load the output drops to about 50 volts peak with a serious ripple. The ripple can decrease to zero volts if there is a significant enough load. However, the peaks of the ripple are in the 50 volt DC range and the readings are taken there.

The 9 volt AC output from the transformer is fed to a zero cross detector 90, with the zero crossing point providing a stable reference. The zero cross detector 90 is used to find the reference point at the peak of the ripple. It senses the peak of the AC, which correlates to the peak of the DC ripple and it goes high on the positive half of the cycle and low on the negative half of the cycle. The transitions are registered to provide the timing to a microcontroller (microcomputer) 92.

The microcontroller 92 comprises a CPU, RAM, ROM, I/O ports and a timer 94. The timer 94 utilizes a ceramic resonator clock which could be crystal controlled for additional accuracy. The CPU of the microcontroller comprises an RISC CPU, which is extremely fast but has a limited amount of memory. For example, there are 24 bytes of RAM and one kilobyte of ROM.

A main CPU 96 is coupled to the microcontroller 92 via I/O ports and a switch matrix. In the illustrative embodiment, the main CPU 96 uses a 6809 CPU chip. A main processor communicates instructions to the microcontroller 92 and the microcontroller feeds back information to the main CPU 96 through the I/O ports.

Pulse forming network 86 is used for detecting the presence and position of the pinball. The pulse forming network 86 shapes the wave so that instead of providing a sinusoid, it provides a symmetric waveform that allows the energy of the coil 62 to be dissipated so that readings can be made quickly. Otherwise, if the sinusoidal wave were used and read over a number of waveforms, an inordinate amount of time would elapse and the ball would be released from the magnet by the time the reading was taken. Thus the pulse forming network 86 provides a pulse to the coil 62 in a form that allows a very quick reading.

Further, the ball can be released from the magnet as a result of game vibration that occurs while the reading is pending. Thus it is important that the reading be as quick as possible and to this end the pulse forming network 86 is utilized to provide a short pulse in the proper form.

The microcontroller 92 provides a signal to the driver 84. The driver 84 comprises a series of transistors for driving the pulse forming network 86. The driver 84 is fed by another power supply 98 which acts like a reservoir, to prevent depletion of the power from the upstream power supply 82 when something else (for example the flippers or pop bumpers, etc.) are being used. Thus during use of such pop bumpers etc., it is necessary to have the proper power supply to the driver 84 in order to prevent depletion of the upstream DC line.

The output from the pulse forming network 86 is fed via line 100 to a voltage comparator 102 and via another line 104 to a zero cross detector 106. The pulse for reading is a narrow pulse, for example about one microsecond wide. This pulse is from the driver 84. There is a pulse from the microcontroller of about five volts fed to the driver 84 which is amplified to about 50 volts and then the pulse is fed to a capacitor in the pulse forming network which dumps the pulse into the electromagnet 48. Thus the pulse forming network 86 receives some one microsecond pulses A as shown in FIG. 9, which results in shaped waveforms B as show in FIG. 11.

FIG. 8 illustrates pulse forming network 86. It is an LCR tank circuit, having a zener diode energy dissipater. The LCR parallel circuit is a well-known tank circuit utilizing, in parallel, an inductance 108, a capacitor 110, and a resistor 112. The zener diode 114 allows the energy to be dissipated by burning off the excess energy in terms of the voltage across the zener diode times the current through the zener diode. It also clamps the voltage to within the rating of the drive transistor in the driver 84.

Figure 9:
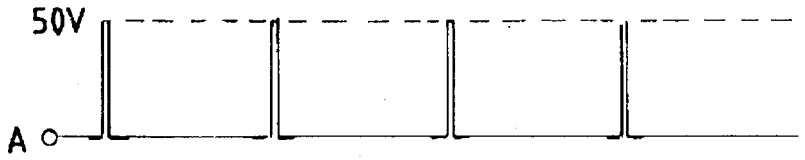
FIGS. 9–22 are timing diagrams of various pulses and waveforms utilized in a pinball game constructed in accordance with the principles of the present invention.
Figure 10:
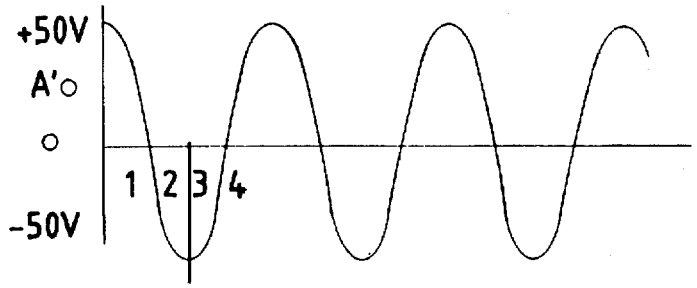
Figure 11:
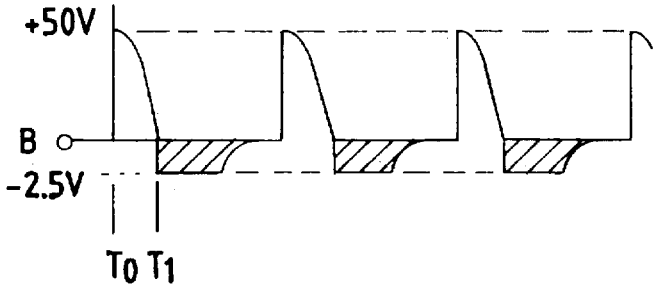

FIGS. 9–11 illustrate the timing system with FIG. 9 showing the driver output pulses A. FIG. 10 illustrates what the waveform A of the coil itself would be if there was no pulse forming network. However, the pulse forming network changes the shapes of these waves as illustrated in FIG. 11. FIG. 11 illustrates the actual output from the pulse forming network to the coil at point B. First, there is the positive part of the wave and, as it swings negative, the clamp limits the negative part of the waveform to minus 7.5 volts. At $T_o$, which is the peak of the wave, measuring begins and a determination is made when $T_1$, which is the zero crossing, occurs. The zero crossing is one-quarter of the wave so it allows that determination to be made quickly. After $T_1$, it is important to dissipate the energy which is occurring as a result of the zener diode and resistor combination. It is important to dissipate the energy quickly so that the energy is shut off to enable another reading to be taken quickly, as stated above.

Figure 12:
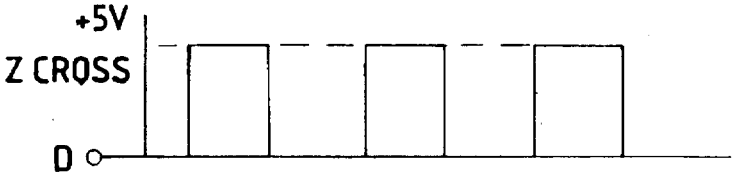
Figure 13:
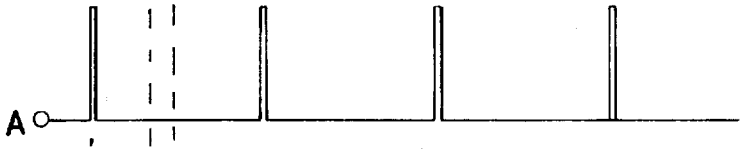
Figure 14:
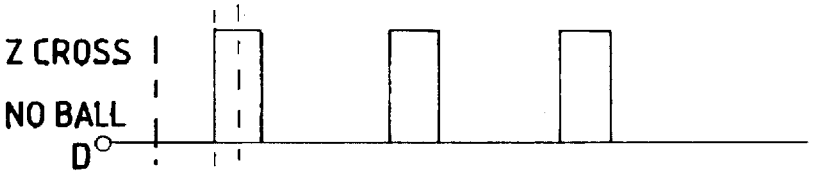
Figure 15:
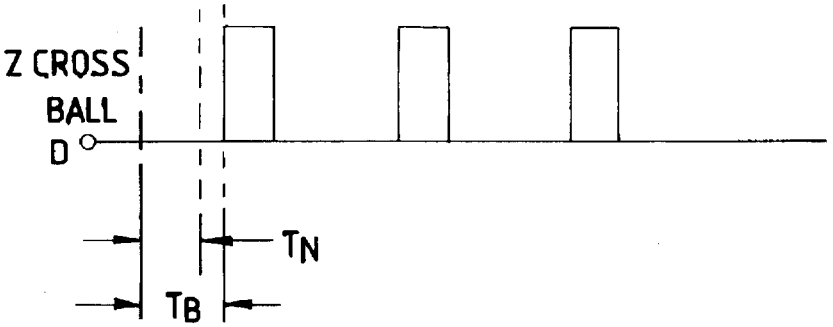
Figure 16:
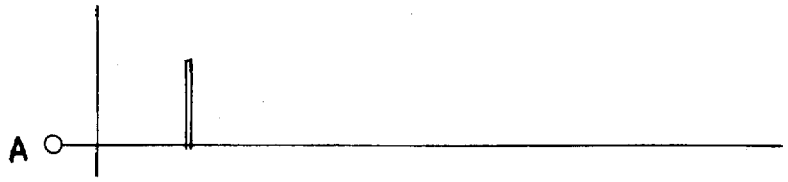

Now referring to FIGS. 13–15, the spikes A into the pulse forming network are shown in FIG. 13. These are the pulses that are either coming out of the microprocessor or out of the amplifier, noting that they are pulses that are time synchronized. As soon as the pulse starts, an internal counter begins. The counter continues on until it measures the input from the zero crossing detector 106. With respect to the zero crossing detector 106, it is noted when the waveform crosses the zero line (see FIG. 12). It then starts a pulse D which is the output of the zero cross detector (see FIGS. 12 and 14). The leading edge of that pulse is noted to determine whether there is a ball present or whether no ball is present. The leading edge of that pulse also provides information as to how close the ball is to the center of the core of the electromagnet.

Figure 17:
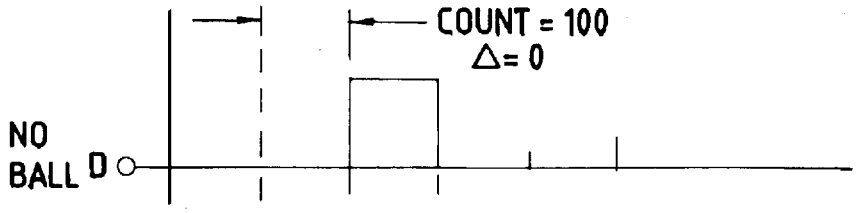
Figure 18:
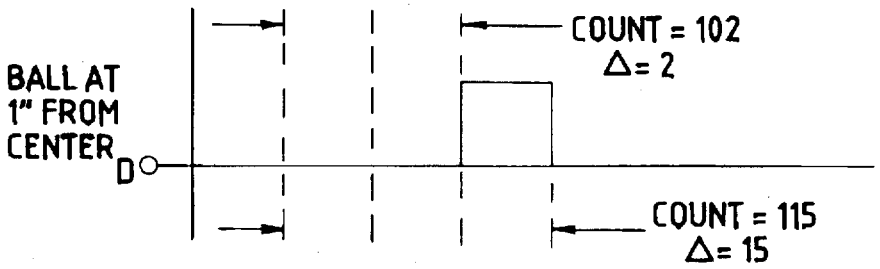
Figure 19:
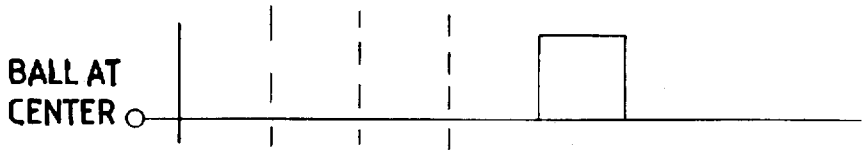

For example, referring to FIGS. 16–19, the system first normalizes itself to the position of no ball when there is no ball present, so that it forms a zero line. If the normalizer count is 100 by the counter, each time it reads it subtracts 100 and if it is at the zero line there is no ball (FIG. 17). Assuming that the counter count is up to 102 and then it subtracts 100. That shows that it is two counts past the zero line which would indicate that there is a ball present (FIG. 18). Two counts would indicate, for example, that the ball is one inch from center. Now assume that the count is 115. The difference (delta) is then 15 and this indicates that the ball is at the center (FIG. 19). Thus counts that are between 100 and 115 indicate the distance of a ball from the center. In FIG. 7 there is illustrated where pulses A, B and D are located in the circuit.

Although it is most important to measure the distance of the ball from the center of the core, the speed of the ball could also be measured. If the ball is approaching the center directly, a relatively accurate speed reading can be taken. Likewise, if the ball is moving down a straight line, a relatively accurate measurement of the speed can be obtained. However, if the ball is curving or hooking, a readily accurate measurement is more difficult. To provide a speed reading, there are a number of look up tables in the ROM of microcontroller 92. Appropriate software is utilized to correlate the distance readings of the ball over time and to utilize the look up tables to determine the speed.

In the operation for attracting and holding the ball, instead of providing a spike from the microcontroller 92 to the driver 84, the microcontroller 92 provides an on pulse C to maintain a magnetic field for the energy to hold the ball by the magnet. The on pulse C is amplified by the driver 84 and fed to the pulse forming network 86. The pulse forming network 86 primarily ignores the on pulse C although it damps out any negative swings on the on pulse.

In the illustrative embodiment, there are several modes. There is the ball detecting mode where short microsecond pulses are utilized (for reading). There is the grab mode where the pinball is attracted and grabbed, and which the on pulse is on for approximately a second and then the hold mode is switched into.

Figure 20:
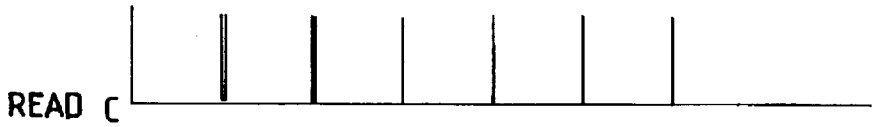
Figure 21:
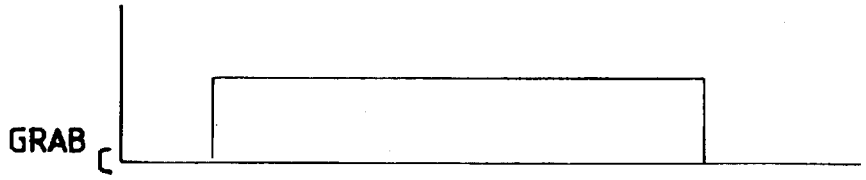
Figure 22:
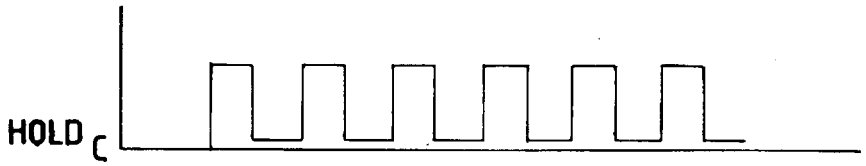

The read pulses C are illustrated in FIG. 20. The grab pulse C is illustrated in FIG. 21 and the hold pulses C are illustrated in FIG. 22. As illustrated in FIG. 22, in the hold mode, the pulses are not merely microsecond pulses nor is there a long on time, but instead the pulses are in milliseconds. For example, the pulses are on for 3.3 milliseconds and off for 4.7 milliseconds. Referring to FIG. 20, the timing is synchronized back to the input for 8 milliseconds so that the spacing between the read pulses is 8 milliseconds just as the duty cycle of the hold pulses is 8 milliseconds. This timing is provided by the timer of the microcontroller 92. However, if current is sensed to be significantly depleted from the coil 62, the off time should not be more than one millisecond.

If foreign AC is used whereby there is 50 hz instead of 60 hz, the timing between pulses is 10 milliseconds rather than 8 milliseconds. It is to be understood that the foregoing times are illustrative examples only, and no limitation is intended with respect to this invention.

Although an illustrative embodiment of the invention has been shown and described, it is to be understood that various modifications and substitutions may be made by those skilled in the art without departing from the novel spirit and scope of the present invention.

What is claimed:

1. A pinball game, which comprises:

a playfield;

at least one pinball for rolling on the playfield;

a supporting structure for the playfield;

an electromagnet positioned on or below the playfield;

a computer-controlled circuit connected to the electromagnet;

said computer-controlled circuit and electromagnet being operable to detect and control the pinball in response to changes in the magnetic field of the electromagnet.

2. A pinball game as defined in claim 1, in which the electromagnet simultaneously detects the pinball and controls its position.

3. A pinball game as defined in claim 1, in which the computer-controlled circuit is responsive to a change of inductance of the electromagnet over time to determine the movement of the pinball.

4. A pinball game as defined in claim 1, in which said magnetic field is operative to (a) attract the pinball and (b) aid in detecting the proximity of the pinball.

5. A pinball game as defined in claim 1, in which said computer-controlled circuit is operative to provide pulses to said electromagnet and to receive return pulses indicative of the proximity of the pinball with respect to the electromagnet.

6. A pinball game as defined in claim 5, in which said computer-controlled circuit includes a computer for generating pulses, a driver for amplifying the pulses generated by the computer, a pulse forming network for shaping the pulses from the driver and for feeding the shaped pulses to the electromagnet.

7. A pinball game as defined in claim 5, in which the return pulses are fed to a zero-crossing detector whereby said proximity of the pinball is indicated in response to the output of the zero-crossing detector.

8. A pinball game as defined in claim 5, in which said computer-controlled circuit is operative to provide pulses to said electromagnet and to receive return pulses indicative of the proximity of the pinball with respect to the electromagnet, said computer-controlled circuit including a computer for generating pulses, a driver for amplifying the pulses generated by the computer, a pulse forming network for shaping the pulses from the driver and for feeding the shaped pulses to the electromagnet.

9. A pinball game as defined in claim 1, in which said computer-controlled circuit is operable to provide different pulses to the electromagnet for (a) detecting the proximity of the pinball, (b) attracting the pinball, and (c) holding the pinball.

10. A pinball game as defined in claim 1, in which said playfield is inclined and comprises an outhole for the pinball, said electromagnet being positioned close to but upstream of said outhole whereby the pinball can be attracted to the electromagnet under predetermined conditions and thereby prevent it from rolling into the outhole.

11. A pinball game as defined in claim 10, in which said playfield has a pair of flippers upstream of the outhole and near the outhole, and the electromagnet is positioned between the flippers and the outhole.

12. A pinball game as defined in claim 10, in which the electromagnet is located below the surface of the playfield.

13. A pinball game as defined in claim 1, in which the computer-controlled circuit is responsive to a change of inductance of the electromagnet over time to determine the movement of the pinball, said computer-controlled circuit being operative to provide pulses to said electromagnet and to receive return pulses indicative of the proximity of the pinball with respect to the electromagnet.

14. A pinball game as defined in claim 13, in which said computer-controlled circuit includes a computer for generating pulses, a driver for amplifying the pulses generated by the computer, a pulse-forming network for shaping the pulses from the driver and for feeding the shaped pulses to the electromagnet, and the return pulses are fed to a zero-crossing detector whereby the proximity of the pinball to the electromagnet is indicated in response to the output of the zero-crossing detector.

15. A pinball game as defined in claim 13, in which said computer-controlled circuit is operable to provide different pulses to the electromagnet for (a) detecting the proximity of the pinball to the electromagnet, (b) attracting the pinball, and (c) holding the pinball.

16. A pinball game as defined in claim 13, in which said playfield is inclined and comprises an outhole for the pinball, said electromagnet being positioned close to but upstream of said outhole whereby the pinball can be attracted to the electromagnet under predetermined conditions and thereby prevent it from rolling into the outhole.

17. A pinball game as defined in claim 16, in which said playfield has a pair of flippers upstream of the outhole and near the outhole, and the electromagnetic is positioned between the flippers and the outhole.

18. A pinball game which comprises:

an inclined playfield;

at least one pinball for rolling on the playfield;

a supporting structure for the playfield;

an outhole for the pinball at a low position on the playfield;

an electromagnet positioned close to but upstream of the outhole whereby the pinball can be attracted to the electromagnet under predetermined conditions and thereby prevent it from rolling into the outhole.

19. A pinball game as defined in claim 18, in which said playfield has a pair of flippers upstream of the outhole and near the outhole, and the electromagnet is positioned between the flippers and the outhole.

20. A pinball game as defined in claim 18, in which the electromagnet is located below the surface of the playfield.

21. A pinball game as defined in claim 18, including a computer-controlled circuit connected to the electromagnet, the computer-controlled circuit being operable to determine the proximity of the pinball with respect to the electromagnet in response to changes in the magnetic field of the electromagnet.

22. A method for operating a pinball game which comprises the steps of:

providing a playfield, at least one pinball for rolling on the playfield, and a supporting structure for the playfield;

providing an electromagnet positioned on or below the playfield; and detecting and controlling the pinball in response to changes in the magnetic field of the electromagnet.

23. A method as defined in claim 22, including the steps of providing pulses to the electromagnet and receiving return pulses indicative of the proximity of the pinball with respect to the electromagnet.

24. A method as defined in claim 23, including the steps of generating the pulses, amplifying the pulse generated, shaping the pulses, feeding the shaped pulses to the electromagnet, feeding return pulses to a zero-crossing detector, whereby the proximity of the pinball is indicated in response to the output of the zero-crossing detector.

* * * * *